US011585036B2

(12) United States Patent
Mariuzzo et al.

(10) Patent No.: US 11,585,036 B2
(45) Date of Patent: Feb. 21, 2023

(54) METHOD FOR OPERATING A LAUNDRY WASHING MACHINE USING A UNIT DOSE PACKAGE AND LAUNDRY WASHING MACHINE IMPLEMENTING THE METHOD

(71) Applicant: Electrolux Appliances Aktiebolag, Stockholm (SE)

(72) Inventors: Marco Mariuzzo, Porcia (IT); Michela Gasparollo, Porcia (IT)

(73) Assignee: Electrolux Appliances Aktiebolag

( * ) Notice: Subject to any disclaimer, the term of this patent is extended or adjusted under 35 U.S.C. 154(b) by 191 days.

(21) Appl. No.: 17/171,193

(22) Filed: Feb. 9, 2021

(65) Prior Publication Data

US 2021/0164150 A1 Jun. 3, 2021

Related U.S. Application Data

(63) Continuation of application No. 16/332,116, filed as application No. PCT/EP2017/072466 on Sep. 7, 2017, now Pat. No. 11,091,870.

(30) Foreign Application Priority Data

Sep. 13, 2016 (EP) ..... 16188493

(51) Int. Cl.
*D06F 39/02* (2006.01)

(52) U.S. Cl.
CPC ..... *D06F 39/02* (2013.01); *D06F 39/028* (2013.01)

(58) Field of Classification Search
CPC ..... D06F 33/34; D06F 33/37; D06F 39/088; D06F 39/02–028
See application file for complete search history.

(56) References Cited

U.S. PATENT DOCUMENTS

| | | | |
|---|---|---|---|
| 2,821,848 | A | 2/1958 | Becker |
| 2,933,912 | A | 4/1960 | Billings |
| 4,882,917 | A | 11/1989 | Mizusawa et al. |
| 5,548,978 | A | 8/1996 | Bongini et al. |
| 5,884,506 | A | 3/1999 | Blauert et al. |
| 7,036,177 | B2 | 5/2006 | Aouad et al. |
| 7,181,934 | B2 | 2/2007 | Hsu et al. |
| 8,931,311 | B2 | 1/2015 | Leibman et al. |

(Continued)

FOREIGN PATENT DOCUMENTS

| | | | |
|---|---|---|---|
| BR | 202014023113 | Y1 | 12/2019 |
| DE | 19537671 | A1 | 4/1997 |
| EP | 1126070 | A1 | 8/2001 |
| EP | 2025798 | A2 | 2/2009 |
| EP | 2239363 | A1 | 10/2010 |

(Continued)

OTHER PUBLICATIONS

USPTO Non Final Office Action issued in U.S. Appl. No. 16/131,921, dated Apr. 30, 2021, 16 pages.

(Continued)

*Primary Examiner* — Spencer E. Bell
(74) *Attorney, Agent, or Firm* — RatnerPrestia

(57) ABSTRACT

A laundry washing machine equipped with a treating agents dispenser comprising a drawer having a compartment suitable to receive a unit dose package comprising a pre-measured amount of treating agent incorporated into a water-soluble pouch. The laundry washing machine has a control unit configured to convey a first amount of water to the compartment to wet the unit dose package, pause, then convey a second amount of water to the compartment for breaking the water-soluble pouch of the unit dose package.

24 Claims, 7 Drawing Sheets

(56) References Cited

U.S. PATENT DOCUMENTS

| | | | |
|---|---|---|---|
| 9,271,627 | B2 | 3/2016 | Alexander et al. |
| 9,574,297 | B2 | 2/2017 | Berndsen et al. |
| 9,637,857 | B2 | 5/2017 | Del Pos et al. |
| 9,663,893 | B2 | 5/2017 | Malheiros |
| 9,850,618 | B2 | 12/2017 | Burger et al. |
| 9,903,063 | B2 | 2/2018 | Carpenter et al. |
| 9,970,148 | B2 | 5/2018 | Alexander et al. |
| 9,976,246 | B2 | 5/2018 | Malheiros |
| 10,480,113 | B2 | 11/2019 | Favaro et al. |
| 10,519,590 | B2 | 12/2019 | Malheiros |
| 10,731,284 | B2 | 8/2020 | Alexander et al. |
| 10,815,607 | B2 | 10/2020 | Costa et al. |
| 2004/0088796 | A1 | 5/2004 | Neergaard et al. |
| 2004/0200245 | A1 | 10/2004 | Cheo et al. |
| 2005/0102767 | A1 | 5/2005 | Aouad et al. |
| 2005/0166645 | A1 | 8/2005 | Favret et al. |
| 2005/0229652 | A1 | 10/2005 | Kim et al. |
| 2005/0241072 | A1 | 11/2005 | Kim et al. |
| 2005/0274156 | A1 | 12/2005 | Yang |
| 2007/0130700 | A1 | 6/2007 | Cho et al. |
| 2007/0163307 | A1 | 7/2007 | Kramme et al. |
| 2007/0240456 | A1 | 10/2007 | Byun et al. |
| 2008/0295546 | A1 | 12/2008 | Cho et al. |
| 2009/0119849 | A1 | 5/2009 | Hill et al. |
| 2009/0293203 | A1 | 12/2009 | Hettinger et al. |
| 2011/0247147 | A1 | 10/2011 | Amos et al. |
| 2012/0060568 | A1 | 3/2012 | Buso et al. |
| 2012/0067089 | A1 | 3/2012 | Buso et al. |
| 2012/0272691 | A1 | 11/2012 | Leibman et al. |
| 2014/0060121 | A1 | 3/2014 | Burger et al. |
| 2014/0060581 | A1 | 3/2014 | Alexander et al. |
| 2014/0060594 | A1 | 3/2014 | Alexander et al. |
| 2014/0157835 | A1 | 6/2014 | Del Pos et al. |
| 2014/0165663 | A1 | 6/2014 | Celotto et al. |
| 2015/0013075 | A1 | 1/2015 | Herrera et al. |
| 2015/0059413 | A1 | 3/2015 | Yoo et al. |
| 2015/0267340 | A1 | 9/2015 | Malheiros |
| 2015/0345069 | A1 | 12/2015 | Leibman et al. |
| 2016/0047077 | A1 | 2/2016 | Leibman et al. |
| 2016/0237612 | A1 | 8/2016 | Ghosh et al. |
| 2017/0073877 | A1 | 3/2017 | Hettinger et al. |
| 2017/0297770 | A1 | 10/2017 | Snider et al. |
| 2018/0073185 | A1 | 3/2018 | Burger et al. |
| 2018/0135226 | A1 | 5/2018 | Alexander et al. |
| 2018/0155864 | A1 | 6/2018 | Alexander et al. |
| 2019/0017208 | A1 | 1/2019 | Marangoni et al. |
| 2019/0136440 | A1 | 5/2019 | Clarke et al. |
| 2020/0370229 | A1 | 11/2020 | Bensel et al. |
| 2021/0025103 | A1 | 1/2021 | Li et al. |

FOREIGN PATENT DOCUMENTS

| | | | |
|---|---|---|---|
| EP | 2241669 | A1 | 10/2010 |
| EP | 3037582 | A1 | 6/2016 |
| EP | 3184688 | A1 | 6/2017 |
| EP | 3257998 | A1 | 12/2017 |
| EP | 3293302 | A1 | 3/2018 |
| EP | 2540902 | B1 | 5/2020 |
| EP | 3660198 | A1 | 6/2020 |
| FR | 1209601 | A | 3/1960 |
| GB | 586424 | | 3/1947 |
| GB | 589374 | | 6/1947 |
| JP | 2016073330 | A | 5/2016 |
| WO | 2005059229 | A1 | 6/2005 |
| WO | 2005061685 | A1 | 7/2005 |
| WO | 2007051988 | A1 | 5/2007 |
| WO | 2015197109 | A1 | 12/2015 |
| WO | 2016101994 | A1 | 6/2016 |
| WO | 2016102005 | A1 | 6/2016 |

OTHER PUBLICATIONS

USPTO Final Office Action for U.S. Appl. No. 16/822,637, dated May 9, 2022, 27 pages.

USPTO Non Final Office Action for U.S. Appl. No. 17/128,947, dated Mar. 2, 2022, 9 pages.

Brazilian Written Opinion issued in Brazilian Application No. 112019003786-1, dated Jun. 23, 2021, 4 pages.

USPTO Notice of Allowance issued in U.S. Appl. No. 16/522,156, dated Jun. 29, 2021, 10 pages.

USPTO Notice of Allowance issued in U.S. Appl. No. 16/131,935, dated Jun. 24, 2021, 12 pages.

Final Office Action for U.S. Appl. No. 16/131,935, dated Mar. 18, 2021, 21 pages.

Notice of Allowance for U.S. Appl. No. 16/131,757, dated Mar. 17, 2021, 30 pages.

Final Office Action for U.S. Appl. No. 16/131,921, dated Mar. 19, 2020, 28 pages.

Notice of Allowance for U.S. Appl. No. 16/332,116, dated Mar. 19, 2021, 23 pages.

USPTO Non Final Office Action issued In U.S. Appl. No. 16/522,156, dated Feb. 10, 2021, 46 pages.

USPTO Notice of Allowance issued in U.S. Appl. No. 16/131,912, dated Feb. 22, 2021, 14 pages.

Notice of Allowance for U.S. Appl. No. 16/822,637, dated Aug. 22, 2022, 7 pages.

USPTO Non Final Office Action for U.S. Appl. No. 17/541,941, dated Mar. 14, 2022, 11 pages.

USPTO Final Office Action issued in U.S. Appl. No. 16/822,728, dated Jul. 12, 2022, 24 pages.

International Search Report and Written Opinion for International Application No. PCT/EP2017/072466, dated Nov. 10, 2017—11 pages.

International Preliminary Report on Patentability for International Application No. PCT/EP2014/079176, dated Jun. 27, 2017, 7 pages.

International Search Report and Written Opinion for International Application No. PCT/EP2014/079129, dated Mar. 23, 2015, 11 pages.

International Search Report and Written Opinion for International Application No. PCT/EP2014/079176, dated Mar. 9, 2015, 9 pages.

International Search Report and Written Opinion for International Application No. PCT/EP2019/072846, dated Oct. 22, 2019, 11 pages.

USPTO Non Final Office Action issued in U.S. Appl. No. 16/131,757, dated Apr. 1, 2020, 17 pages.

International Search Report and Written Opinion for International Application No. PCT/IB2019/000746, dated Jun. 25, 2020, 18 pages.

USPTO Non Final Office Action issued in U.S. Appl. No. 16/131,912, dated Aug. 19, 2020, 19 pages.

USPTO Final Office Action issued in U.S. Appl. No. 16/131,757, dated Aug. 6, 2020, 15 pages.

USPTO Non Final Office Action issued in U.S. Appl. No. 16/131,757, dated Oct. 16, 2020, 20 pages.

International Search Report and Written Opinion for International Application No. PCT/EP2020/068875, dated Sep. 22, 2020, 11 pages.

International Search Report and Written Opinion for International Application No. PCT/EP2020/071064, dated Nov. 9, 2020, 14 pages.

USPTO Non Final Office Action issued in U.S. Appl. No. 16/131,921, dated Dec. 22, 2020, 32 pages.

USPTO Notice of Allowance issued in U.S. Appl. No. 16/131,912, dated Dec. 9, 2020, 17 pages.

USPTO Notice of Allowance issued in U.S. Appl. No. 15/537,701, dated May 19, 2020, 9 pages.

USPTO Non Final Office Action issued in U.S. Appl. No. 16/131,935, dated Jan. 25, 2021, 14 pages.

USPTO Notice of Allowance issued in U.S. Appl. No. 16/332,116, dated Jan. 25, 2021, 8 pages.

Entire patent prosecution history of U.S. Appl. No. 16/332,116, filed Mar. 11, 2019, entitled, "Method for Operating a Laundry Washing Machine Using a Unit Dose Package and Laundry Washing Machine Implementing the Method."

Non Final Office Action for U.S. Appl. No. 16/822,728, dated Oct. 24, 2022, 12 pages.

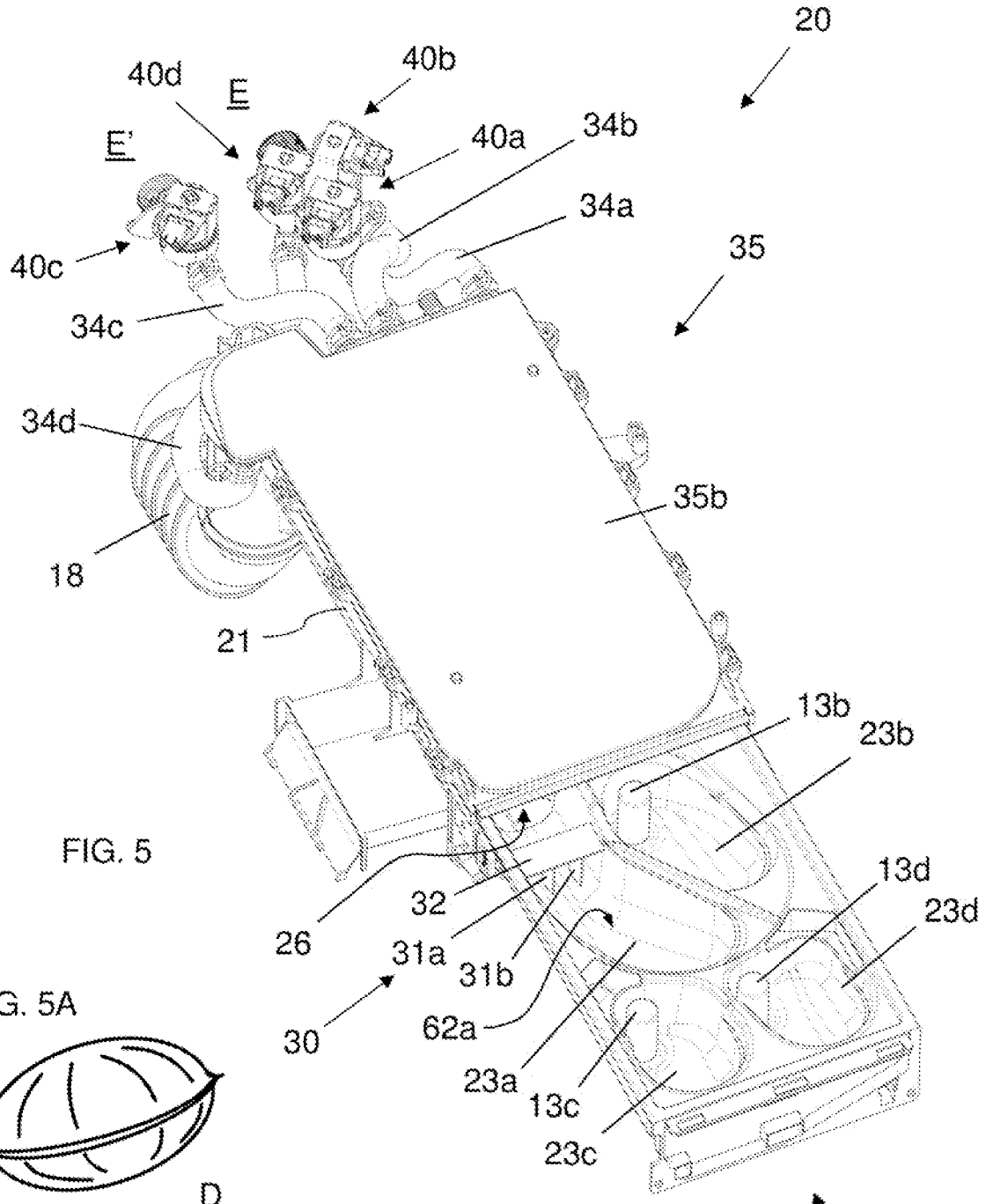
FIG. 5
FIG. 5A
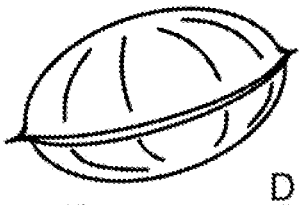
DP
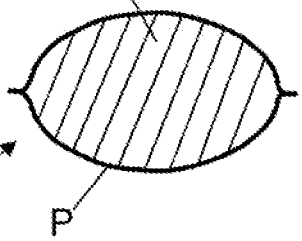
FIG. 5B

METHOD FOR OPERATING A LAUNDRY WASHING MACHINE USING A UNIT DOSE PACKAGE AND LAUNDRY WASHING MACHINE IMPLEMENTING THE METHOD

CROSS REFERENCE TO RELATED APPLICATIONS

This application is a continuation of U.S. application Ser. No. 16/332,116, filed on Mar. 11, 2019, which is a U.S. National Phase application of PCT International Application No. PCT/EP2017/072466, filed Sep. 7, 2017, which claims the benefit of EP 16188493.7, filed Sep. 13, 2016, all of which are incorporated by reference herein.

FIELD OF THE INVENTION

The present invention concerns the field of laundry washing techniques.

In particular, the present invention refers to a method for operating a laundry washing machine using a unit dose package, more particularly a unit dose detergent.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing, or cabinet, provided with a washing tub which contains a rotatable perforated drum where the laundry is placed. A loading/unloading door ensures access to the drum.

Laundry washing machines typically comprise a water supply unit and a products supply unit, or dispenser, for the introduction of water and treating agents (i.e. detergent, softener, rinse conditioner, etc.) into the tub.

At the beginning of each washing cycle, compartments of the dispenser are therefore filled with the respective dose of treating agent. Traditional treating agents typically comprise powder or liquid detergents, liquid softeners, liquid rinse conditioners etc.

Alongside the traditional powder or liquid treating agents, unit dose packages have been introduced in the market by the treating agents manufactures. The unit dose package comprises a pre-measured amount of treating agent incorporated into a water-soluble pouch, wherein the treating agent preferably includes detergent. Hereinafter we will indicate said unit dose package simply with the term "pod".

It is known from WO2016102005A1 a method for using a pod by introducing it into one respective compartment of the dispenser.

The method preferably comprises a package breakage step of breaking the water-soluble pouch of the pod inside the respective compartment so as to release the pre-measured amount of treating agent incorporated therein.

The step of breaking the water-soluble pouch is carried out through water conveyed into the compartment which dissolves the water-soluble pouch or by means of a water jet which hits the pod and breaks the water-soluble pouch.

The method then preferably comprises a step of conveying an amount of flushing water into said compartment to flush out the released pre-measured amount of treating agent from the compartment and convey it into the washing tub.

The use of pods according to the known technique, nevertheless, revealed some drawbacks.

It has been recognized that the use of pods in compartments of the drawer causes the water-soluble pouch of the pod to stuck at the side walls of the compartment.

This is due to the gelatinous state reached by the water-soluble pouch.

Residues of pouch therefore accumulate and form a sticky, gelatinous mass, which will ultimately adhere to the side walls of the compartment.

Accumulation of product may favour the proliferation of bacteria, which may then worsen the hygienic conditions and/or may cause bad smells.

Furthermore, cleaning operations are frequently required to remove said residues from side walls of the compartment. This is a wasteful process.

The object of the present invention is therefore to overcome the drawbacks posed by the known technique.

It is an object of the invention to provide a method for operating a laundry washing machine using a unit dose package which prevents accumulation of residues in the treating agents dispenser.

It is another object of the invention to provide a laundry washing machine that makes it possible to reduce proliferation of bacteria therefore improving hygienic conditions.

It is a further object of the invention to provide a laundry washing machine that makes it possible to reduce wasteful process for cleaning the treating agents dispenser.

DISCLOSURE OF INVENTION

The applicant has found that by providing a method for operating a laundry washing machine suitable to use a unit dose package comprising a pre-measured amount of treating agent incorporated into a water-soluble pouch wherein the method comprises a steps of conveying a first amount of water suitable to wet said unit dose package, making a pause for a period of time and conveying a second amount of water suitable to break said water-soluble pouch of said unit dose package, it is possible to overcome drawbacks of known technique.

The present invention relates, therefore, to a method for operating a laundry washing machine, said laundry washing machine comprising:

- a cabinet supporting a washing drum adapted to receive laundry and a washing tub external to said washing drum;
- a treating agents dispenser comprising one or more compartments and one or more water conveying lines for conveying water to said one or more compartments, wherein a first one of said one or more compartments is suitable to receive a unit dose package comprising a pre-measured amount of treating agent incorporated into a water-soluble pouch;
- a supply line, fluidly connecting said treating agents dispenser and said washing tub;

wherein said method comprises the steps of:

- conveying a first amount of water to said first compartment during a first period of time from at least one of said one or more water conveying lines, said first amount of water being suitable to wet said unit dose package;
- making a pause for a second period of time;
- conveying a second amount of water to said first compartment, said second amount of water being suitable to perform a breakage step for breaking said water-soluble pouch of said unit dose package inside said first compartment so that said pre-measured amount of treating agent is released.

In a preferred embodiment of the invention, the breakage step comprises a step of generating at least one water jet into the first compartment from a first one of said one or more water conveying lines so that said at least one water jet is suitable to hit the unit dose package and to break the water-soluble pouch.

According to a preferred embodiment of the invention, the step of generating at least one water jet includes a step of generating at least one laminar-flow water jet.

Preferably the laminar-flow water jet is a coherent stream of water.

Preferably the laminar-flow water jet is a flow which substantially maintains its shape (or cross section) throughout its extension.

In a preferred embodiment of the invention, the first period of time is comprised between 1 sec and 10 sec, more preferably equal to 3 sec.

In a preferred embodiment of the invention, the second period of time is comprised between 5 sec and 150 sec, more preferably equal to 30 sec.

In a preferred embodiment of the invention, the second amount of water is comprised between 1 litre and 7 litres, more preferably equal to 4 litres.

According to a preferred embodiment of the invention, the second amount of water is conveyed for a time period suitable to break the water-soluble pouch.

In a preferred embodiment of the invention the method comprises, after the breakage step, a step of conveying a third amount of water to the first compartment, the third amount of water being suitable to clean the first compartment and/or to flush out said released pre-measured amount of treating agent from the first compartment and to convey it into the washing tub through the supply line.

In a preferred embodiment of the invention, the third amount of water is comprised between 1 litre and 12 litres, more preferably equal to 6 litres.

According to a preferred embodiment of the invention, the method comprises a step of introducing the unit dose package into the first compartment before the step of conveying a first amount of water to the first compartment.

Preferably, the step of introducing the unit dose package into the first compartment comprises positioning the unit dose package in a predefined zone inside the first compartment.

In a preferred embodiment of the invention, the step of generating at least one water jet into said first compartment comprises directing said at least one water jet towards a predefined zone inside said first compartment which is suited for receiving said unit dose package.

According to a preferred embodiment of the invention, the breakage step is carried out if the user selects a dedicated washing program through an interface unit. More preferably, the user selects the dedicated washing program by operating a selector device of the interface unit.

According to a further preferred embodiment of the invention, the breakage step is carried out automatically upon detection of the presence of the unit dose package in the first compartment.

In a preferred embodiment of the invention, said one or more compartments are adapted to be filled with at least one treating agent.

Preferably, the treating agent is at least one of the following: a detergent, a softener, a rinse additive, a fabric conditioner, a washing booster, a waterproofing agent, a fabric enhancer, a rinse sanitization additive, a chlorine-based additive.

Preferably, the pre-measured amount of treating agent is powder or liquid or paste or waxy or a gel composition or a combination thereof.

Preferably, water is cold or warm water.

Preferably the laundry washing machine comprises a control unit for controlling functioning of said laundry washing machine.

Preferably the laundry washing machine comprises an interface unit by means of which a user may select and/or set parameters.

The present invention further relates to a method for operating a laundry washing machine, said laundry washing machine comprising:

- a cabinet supporting a washing drum adapted to receive laundry and a washing tub external to said washing drum;
- a treating agents dispenser comprising one or more compartments and one or more water conveying lines for conveying water to said one or more compartments;
- a supply line, fluidly connecting said treating agents dispenser and said washing tub;

wherein said method comprises the steps of:

- introducing a unit dose package comprising a pre-measured amount of treating agent incorporated into a water-soluble pouch into a first one of said one or more compartments;
- conveying a first amount of water to said first compartment during a first period of time from at least one of said one or more water conveying lines to wet said unit dose package;
- making a pause for a second period of time;
- performing a breakage step of breaking said water-soluble pouch of said unit dose package inside said first compartment by conveying a second amount of water to said first compartment so as to release said pre-measured amount of treating agent.

In a preferred embodiment of the invention, the breakage step comprises a step of generating at least one water jet into the first compartment from a first one of said one or more water conveying lines so that said at least one water jet hits the unit dose package and breaks the water-soluble pouch.

According to a preferred embodiment of the invention, the method comprises, after the breakage step, a step of conveying a third amount of water to the first compartment to clean the first compartment and/or to flush out the released pre-measured amount of treating agent from the first compartment and convey it into the washing tub through the supply line.

Preferably, the method comprises a step of positioning the unit dose package in a predefined zone inside the first compartment.

In a further aspect thereof, the present invention concerns a laundry washing machine suited to implement the method of the invention described above.

BRIEF DESCRIPTION OF THE DRAWINGS

Further characteristics and advantages of the present invention will be highlighted in greater detail in the following detailed description of a preferred embodiment of the invention, provided with reference to the enclosed drawings. In the drawings, corresponding characteristics and/or components are identified by the same reference numbers. In such drawings:

FIG. 5 is a prospective view of the treating agents dispenser, isolated from the rest, of the laundry washing machine represented in FIG. 2 with the drawer in its opened loading position;

FIG. 5A shows a unit dose detergent usable in laundry washing machine represented in FIG. 1 and in the treating agents dispenser represented in FIG. 5;

FIG. 5B is a sectional view of the unit dose detergent of FIG. 5A;

DETAILED DESCRIPTION OF THE INVENTION

Figure 2:
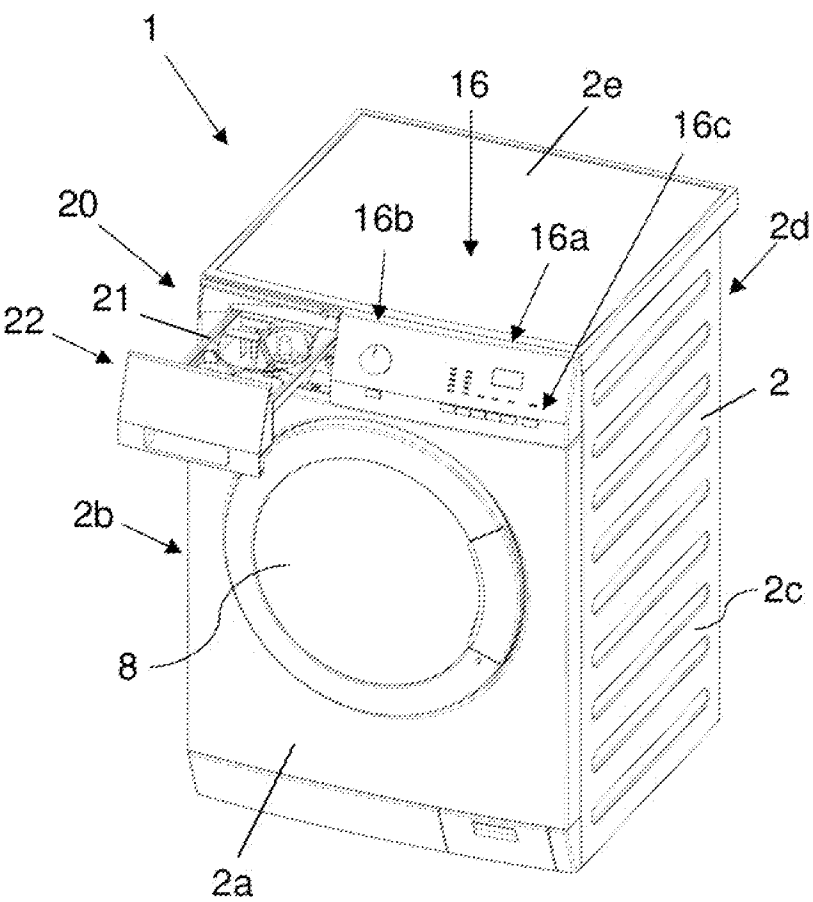
FIG. 2 shows the laundry washing machine of FIG. 1 with the drawer in its opened loading position.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines.

A laundry washing machine 1 where a method according to a preferred embodiment of the invention is performed is described with reference to FIGS. 1 to 9.

The laundry washing machine 1 comprises an external casing or cabinet 2, in which a washing tub 3 is provided that contains a perforated washing drum 4 where the laundry to be treated can be loaded. The external casing 2 comprises vertical side walls 2*a*-2*d* and an upper side wall 2*e*.

The tub 3 and the drum 4 both preferably have a substantially cylindrical shape. Between the tub 3 and the drum 4 a gap is defined.

The cabinet 2 is provided with a loading/unloading 8 which allows access to the drum 4.

The tub 3 is preferably suspended in a floating manner inside the cabinet 2, advantageously by means of a number of coil springs and shock-absorbers 17.

The drum 4 is advantageously rotated by an electric motor 9 which preferably transmits the rotating motion to the shaft of the drum 4, advantageously by means of a belt/pulley system. In a different embodiment of the invention, the motor can be directly associated with the shaft of the drum 4.

The drum 4 is advantageously provided with holes which allow the liquid flowing therethrough. Said holes are typically and preferably homogeneously distributed on the cylindrical side wall of the drum 4.

The tub 3 is preferably connected to the cabinet 2 by means of an elastic bellows 7, or gasket. The bellows 7 is preferably S-shaped.

Figure 3:
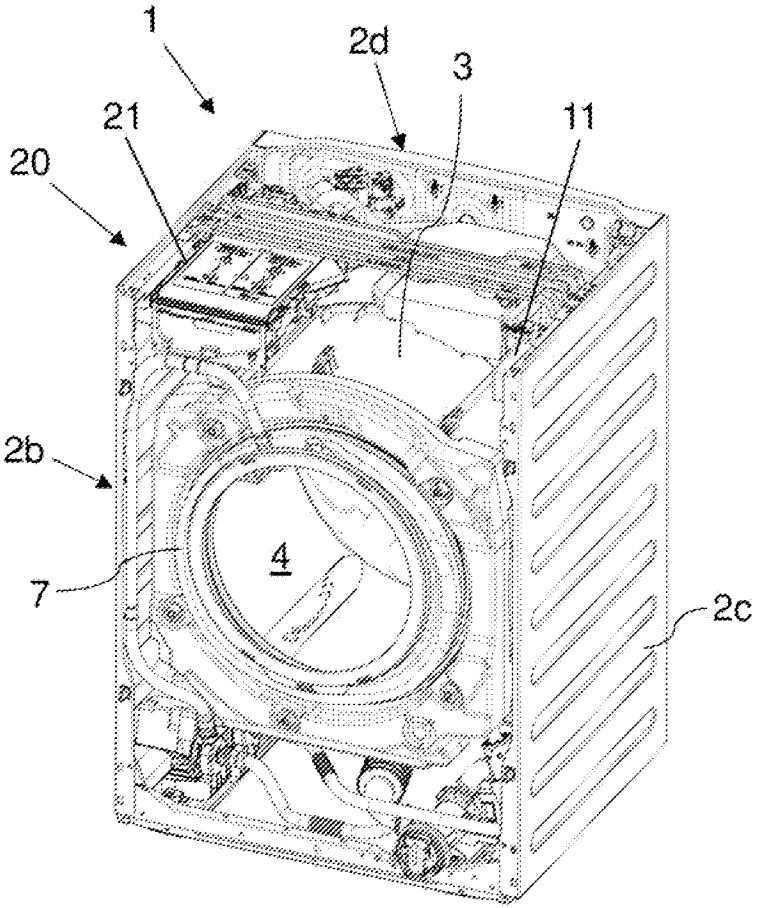
FIG. 3 shows the laundry washing machine of FIG. 1 with the front side wall and the upper side wall removed.

Laundry washing machine 1 advantageously comprises a control unit 11, illustrated in FIG. 3, connected to the various parts of the laundry washing machine 1 in order to ensure its operation. Laundry washing machine 1 preferably comprises an interface unit 16, connected to the control unit 11, accessible to the user and by means of which the user may select and set the washing parameters, like for example a desired washing program. Usually, other parameters can optionally be inserted by the user, for example the washing temperature, the spinning speed, etc. The interface unit 16 preferably comprises a display 16*a* which displays machine working conditions.

The unit interface 16 then preferably comprises one or more selector devices which allow to select the appropriate wash program and/or to set other parameters.

For example, the selector devices may comprise a selector 16*b* (a rotary knob) which advantageously allows to select the appropriate washing program. The selector devices may then preferably comprise push buttons. In a preferred embodiment, one of the push buttons is advantageously dedicated for selection of a program which uses a detergent pod, as will be described later. Thus we can refer hereinafter to a "Pods cycle" button 16*c*.

In further preferred embodiments, the selection of the washing program which uses a detergent pod may be obtained through other selector devices, for example through the selector 16*b*.

In further embodiments, the selector devices may comprise other type of device, such as capacitive switch, touch screen, etc. In a preferred embodiment, the touch screen may coincide with the display 16.

In further preferred embodiments, the washing program which uses a detergent pod may be one of the washing programs available and selectable by the user, for example through a rotary knob which may be positioned in a plurality of positions each relative to a washing program, one of these positions being relative to said washing program which uses a detergent pod.

The laundry washing machine 1 advantageously comprises a treating agents dispenser 20 to supply treating agents into the tub 3 during a washing cycle. Treating agents may comprise, for example, detergents, rinse additives, fabric softeners or fabric conditioners, waterproofing agents, fabric enhancers, rinse sanitization additives, chlorine-based additives, etc.

Advantageously, the treating agents dispenser 20 comprises a box-shaped housing 21, connected to the external casing 2, internally to the latter, preferably by suitable fixing means, comprising, for example, screws or rivets, not illustrated, or also glue, or welding.

In the enclosed Figures, the housing 21 is advantageously substantially parallelepiped, and it is connected to the frontal side wall 2*a* of the external casing 2, opportunely in an upper region of the latter, positioned above the tub 3.

Figure 1:
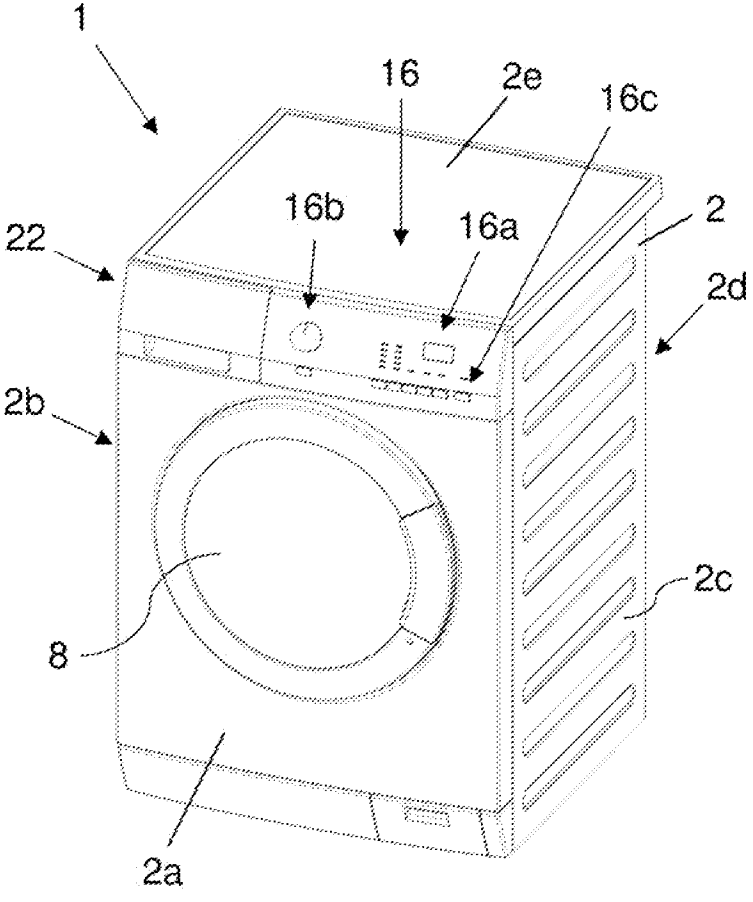
FIG. 1 shows a perspective view of a laundry washing machine in which a method according to a first embodiment of the invention is performed.
Figure 4:
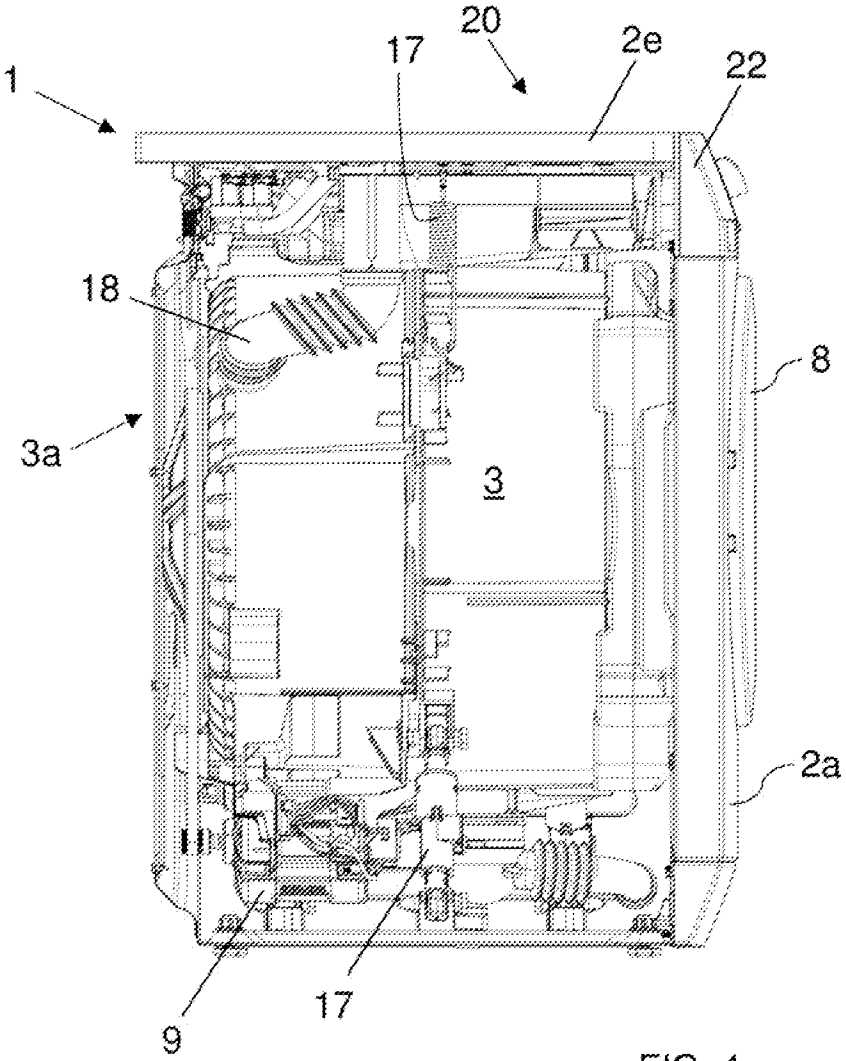
FIG. 4 shows a lateral plan view of the laundry washing machine of FIG. 1 with the left side wall removed.
Figure 8:
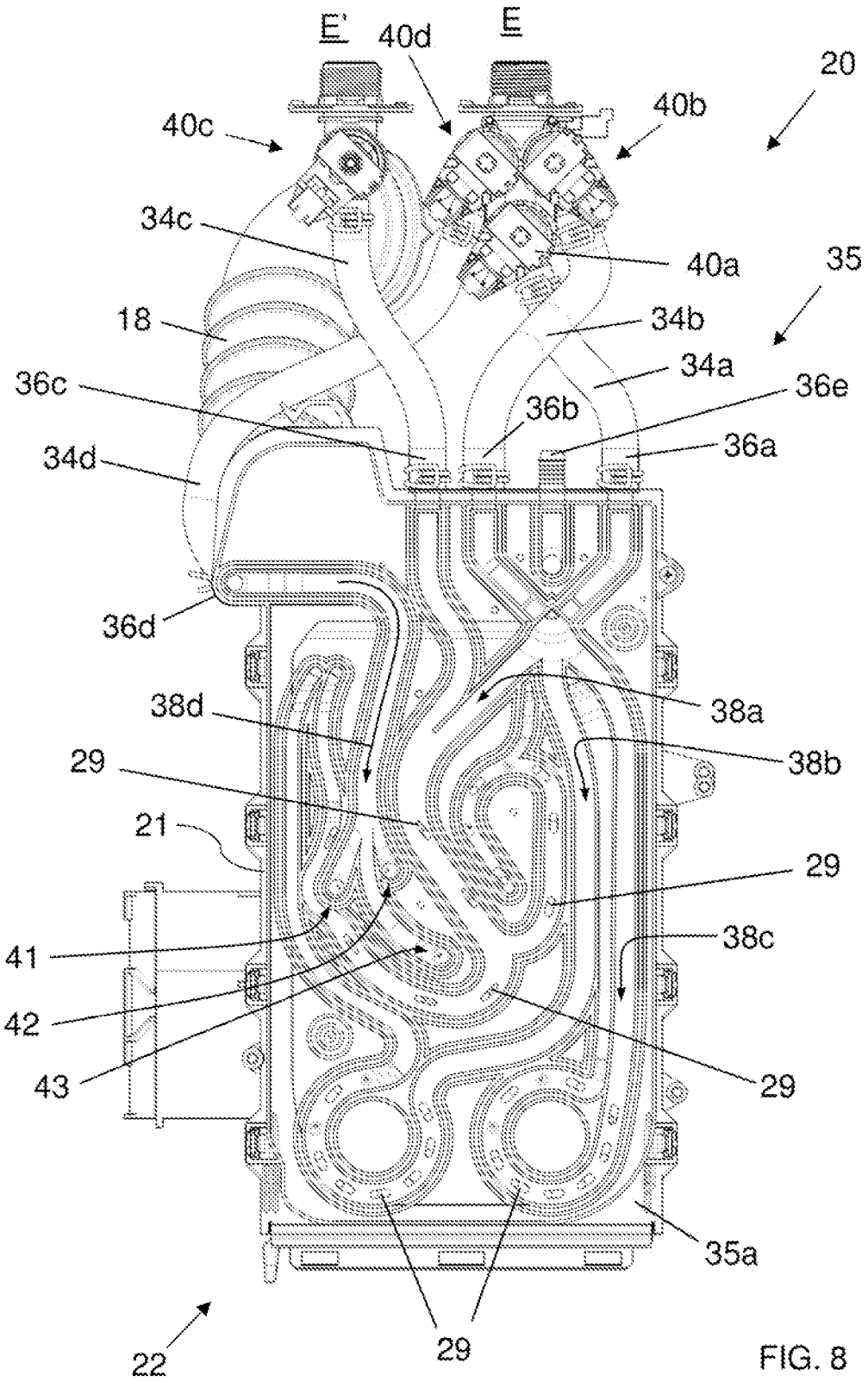
FIG. 8 is a plan view of the treating agents dispenser of FIG. 6 with the drawer in its closed position.

The housing 21 contains a removable drawer 22 which can be extracted from the housing 21, such as to protrude from the external casing 2 in an opened loading position, as illustrated for example in FIGS. 2 and 5, or can be fully inserted into the housing 21 in an operative position, as illustrated for example in FIGS. 1 and 8.

The drawer 22 is provided with one or more compartments 23*a*, 23*b*, 23*c*, 23*d* adapted to be filled with treating agents.

In the embodiment illustrated in the Figures, there are four compartments, 23*a*, 23*b*, 23*c* and 23*d*.

The first compartment 23*a* is preferably adapted for receiving a unit dose package DP or a powder detergent; the second compartment 23*b* is preferably adapted for receiving a quantity of liquid detergent; the third compartment 23*c* is preferably adapted for receiving a softener; the fourth compartment 23*d* is preferably adapted for receiving other treating agents, such as fabric conditioners, waterproofing agents, fabric enhancers, rinse sanitization additives, chlorine-based additives, etc.

With "unit dose package" it is meant a product comprising a pre-measured amount, or single dose, of treating agent incorporated into a water-soluble pouch. In the preferred embodiment here described, the treating agent is detergent D. Hereinafter, therefore, the unit dose package will be simply indicated as "detergent pod DP".

For example, the detergent pod DP comprises a pre-measured amount, or single dose, of detergent D incorporated into a water-soluble pouch P, as illustrated in FIGS. 5A and 5B.

Detergent D may comprise any type of detergent, for example powder, liquid, paste, waxy or gel compositions.

In the further preferred embodiments, the treating agent may comprise different agents. For example, the treating agent may comprise products known as boosters, as borax, washing soda, etc.

The pouch P preferably comprises a water-soluble film. In some examples, the liquid detergent products may be incorporated into a multi-compartment water-soluble pouch.

The pouches may be made of a film material that is soluble or dispersible in water. The pouches have a percentage of water-solubility, for example a water-solubility of at least 50%, preferably of at least 75% or more preferably at least 95%.

Suitable pouch materials may include, but are not limited to, polymeric materials. In some examples, the polymers are formed into a film or sheet. The pouch material can, for example, be obtained by casting, blow-moulding, extrusion or blown extrusion of the polymeric material, as known in the art.

Other polymers, copolymers or derivatives thereof suitable for use as pouch material may be selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. In some examples, polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. The level of polymer in the pouch material, for example a PVA polymer, may be at least 60%.

The polymer can have any weight average molecular weight of from 1000 to 1,000,000, in some examples from 10,000 to 300,000, and in further examples from 20,000 to 150,000.

Mixtures of polymers can also be used as the pouch material. This can be beneficial to control the mechanical and/or dissolution properties of the compartments or pouch, depending on the application thereof and the required needs.

Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of 10,000-40,000, in some examples a weight average molecular weight of about 20,000, and of PVA or copolymer thereof, with a weight average molecular weight of 100,000 to 300,000, in some examples a weight average molecular weight of about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising 1-35% by weight polylactide and 65% to 99% by weight polyvinyl alcohol. In some examples, polymers for use herein are from 60% to 98% hydrolysed, and in further examples from 80% to 90% hydrolysed, to improve the dissolution characteristics of the material.

It will be obvious according to one skilled in the art that different film materials and/or films of different thickness may be employed in making the compartments. A benefit in selecting different films is that the resulting compartments may exhibit different solubility or release characteristics.

The pouch material herein can comprise one or more additive ingredients. For example, it can be beneficial to add plasticisers, for example glycerol, ethylene glycol, diethyleneglycol, propylene glycol, sorbitol and mixtures thereof.

Other additives include functional detergent additives to be delivered to the wash water, for example organic polymeric dispersants, etc.

For reasons of deformability pouches or pouch compartments containing a component which is liquid will preferably contain an air bubble having a volume of up to 50%, alternatively up to 40%, alternatively up to 30%, alternatively up to 20%, alternatively up to 10% of the volume space of said compartment.

The compartments 23*a*, 23*b*, 23*c* and 23*d* of the drawer 22 are fluidly connected to the bottom 21*a* of the housing 21, particularly to the rear portion 21*b* of this bottom 21*a*, in which an outlet port 24 is obtained. The outlet port 24 is adapted to allow the flowing of a liquid into a supply pipe 18 fluidly connecting the treating agents dispenser 20 and the tub 3, as visible in FIG. 4.

The supply pipe 18 is preferably arranged laterally with respect to the tub 3 and preferably terminates at an upper region 3*a* of the tub 3. More preferably, the supply pipe 18 terminates at a rear side of the tub 3.

The bottom 21*a* of the housing 21 preferably has a sloped bottom so that a fluid may flow towards the outlet port 24. The outlet port 24 is preferably located at the rear of the sloped bottom wall 21*a*.

The first compartment 23*a* of the drawer 22 is fluidly connected to the bottom 21*a* of the housing 21 through an aperture 26 defined at the rear of the first compartment 23*a*.

It is underlined that in the present application saying that a first component is "fluidly connected" to a second component means that a fluid can flow from the first component to the second component and/or vice versa.

The first compartment 23*a* preferably has a sloped bottom wall 62*a* so that a fluid may flow towards the aperture 26. The aperture 26 is located at the rear of the sloped bottom wall 62*a*.

The first compartment 23*a* then preferably comprises a stopping device 30 adapted for stopping the detergent pod DP and preventing it reaching the rear aperture 26 of the first compartment 23*a*. The stopping device 30 is suited to stop the detergent pod DP when the detergent pod DP is intact while it is configured to allow the passage of detergent D which exits the detergent pod DP after its breakage, as will be better described later.

In the embodiment illustrated, the stopping device 30 preferably comprises two ribs 31*a*, 31*b*, vertically arranged in the first compartment 23*a*. An horizontal element 32 connects the ribs 31*a*, 31*b* to lateral side walls of the first compartment 23*a*.

In different embodiments, not illustrated, the stopping device may be differently realized. In a particular case, the compartment itself may be properly shaped so that it accomplishes the function of stopping the detergent pod inserted therein.

In further different embodiments, the stopping device may be omitted. In this case, the detergent pod may be preferably placed in a predefined zone of the compartment.

The other compartments 23*b*, 23*c* and 23*d* of the drawer 22 are preferably fluidly connected to the bottom 21*a* of the housing 21 through respective siphons 13*b*, 13*c*, 13*d*.

Advantageously, the treating agents dispenser 20 comprises a water distributor 35, associated to the housing 21 and placed above the drawer 22 in such a way to allow the flowing of water to one or more of said compartments 23*a*, 23*b*, 23*c*, 23*d*.

Figure 6:
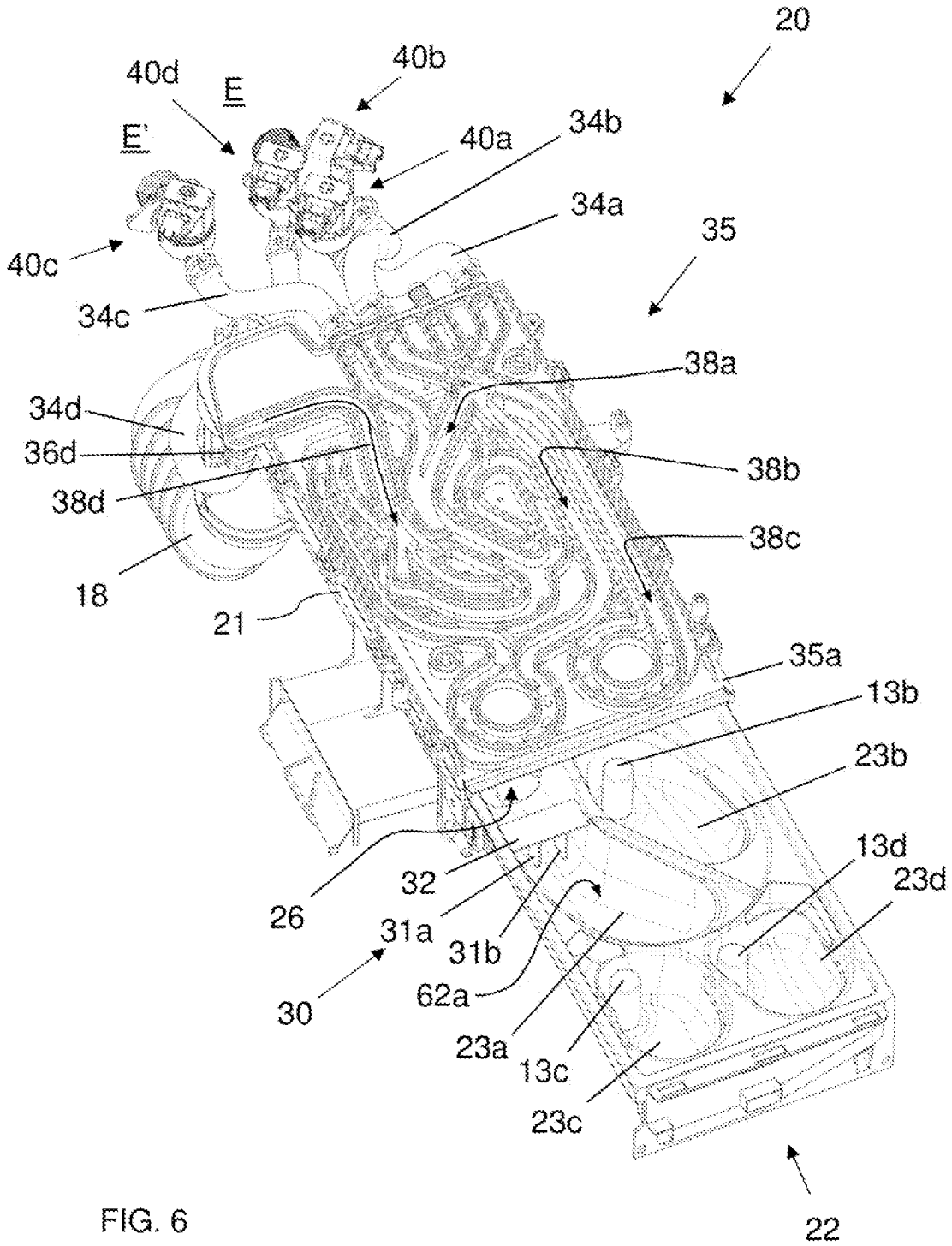
FIG. 6 shows the treating agents dispenser of FIG. 5 with an element removed therefrom.
Figure 7:
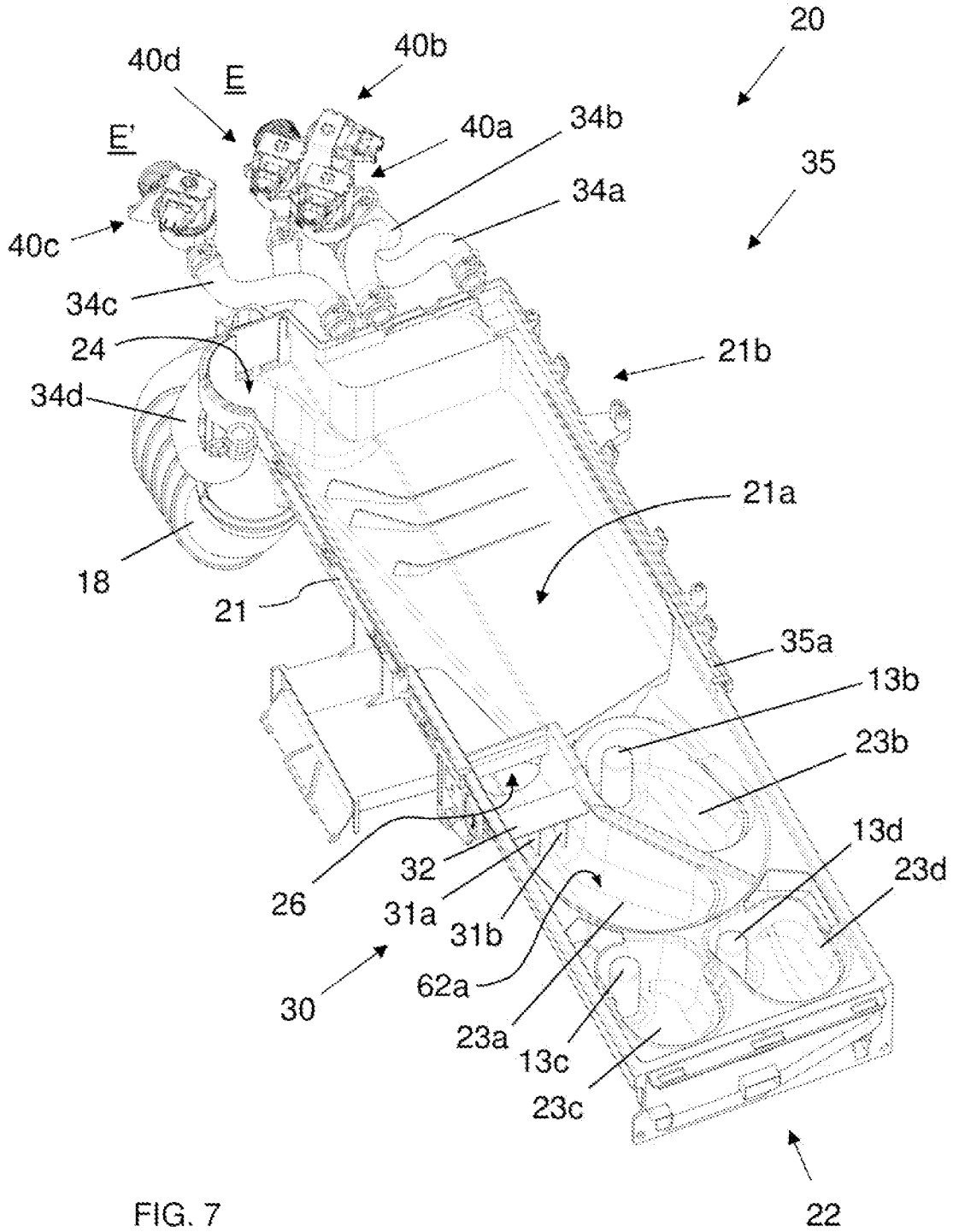
FIG. 7 shows the treating agents dispenser of FIG. 6 with a further element removed therefrom.

The treating agents dispenser 20 comprises one or more water conveying lines 38*a*, 38*b*, 38*c*, as illustrated for example in FIGS. 6 and 8, adapted for conveying water to one or more of said compartments 23*a*, 23*b*, 23*c*, 23*d*.

The water distributor 35 preferably comprises a lower part 35*a* and an upper closing part 35*b* structured for being reciprocally coupled to form the water distributor 35. The two parts 35*a*, 35*b* are preferably coupled by welding and/or glueing and/or joint.

Advantageously, the water distributor 35 comprises a first inlet connector 36*a* and a second inlet connector 36*b* connectable to a water source E which could comprise, for example, the plumbing of the building in which the laundry washing machine 1 is installed.

Advantageously the first and second inlet connectors 36*a*, 36*b* can be connected to the water source E via first and second controllable valves 40*a*, 40*b*, preferably of the electromagnetic type, opportunely controlled by the control unit 11. In the embodiment illustrated in the enclosed Figures, the two inlet connectors 36*a*, 36*b* can be connected via the dedicated controllable valves 40*a*, 40*b*, to the water source E for the adduction of cold water.

Inlets of the two controllable valves 40*a*, 40*b* are connectable to the water source E and outlets of the two controllable valves 40*a*, 40*b* are connected, through respective pipes 34*a*, 34*b*, to the two inlet connectors 36*a*, 36*b* of the water distributor 35.

Preferably, the controllable valves 40*a*, 40*b* comprise a regulator system that automatically cuts off the flow of water flowing therethrough at a certain maximum pressure. Preferably, the maximum pressure is set at a value comprises between 1.7 and 2.4 bar.

In the embodiment illustrated in the enclosed Figures there is also provided a third inlet connector 36*c* connectable, via a third controllable valve 40*c*, to a warm or hot water source E'; the further inlet connector 36*c* can be fed with warm or hot water, for example obtained by a solar thermal collector; in a further embodiment, not illustrated, there could be more than one further inlet connectors, connected to one or more water sources.

Inlet of the third controllable valve 40*c* is connectable to the water source E' and outlet of the third controllable valve 40*c* is connected, through a respective pipe 34*c*, to the third inlet connector 36*c* of the water distributor 35.

The water conveying lines 38*a*, 38*b*, 38*c* are fluidly connected to the inlet connectors 36*a*, 36*b*. Each one of said water conveying lines 38*a*, 38*b*, 38*c* fluidly communicates with a different region of the water distributor 35. Each region is positioned in such a way to be placed above a respective compartment 23*a*, 23*b*, 23*c*, 23*d* of the drawer 22 when the latter is placed in its closed operative position.

The regions of the water distributor 35 are provided with one or more outlets 29 that allow the passage of the water from the water conveying lines 38*a*, 38*b*, 38*c* to the underlying compartments 23*a*, 23*b*, 23*c*, 23*d*.

Outlets 29 and water conveying lines 38*a*, 38*b*, 38*c* are opportunely shaped so that the water substantially falls by gravity into the underlying compartments 23*a*, 23*b*, 23*c*, 23*d*.

By acting on the controllable valves 40*a*, 40*b* and 40*c*, it is possible to selectively feed one of the water conveying lines 38*a*, 38*b*, 38*c* and one or more compartments 23*a*, 23*b*, 23*c*, 23*d* with water coming from the water source E or warm water source E'.

In a further preferred embodiment, not illustrated, the water distributor may comprise a dedicated water conveying line and valve for each compartment.

In another embodiment, not illustrated, in the drawer there can be more than four compartments, and in the water distributor there can be more than three water conveying lines, each one fluidly communicating with a different region of the water distributor which is positioned in such a way to be placed above a different compartment of the drawer when the latter is placed in its closed operative position; also in this case, by acting on the controllable valves, it is possible to selectively feed a desired water conveying line with water coming from the water source/s.

In further embodiments, not illustrated, in the drawer there can be less than four compartments, even just one, and in the water distributor there can be less than three water conveying lines, each one fluidly communicating with a different region of the water distributor which is positioned in such a way to be placed above a different compartment of the drawer when the latter is placed in its closed operative position; also in this case, by acting on the controllable valves, it is possible to selectively feed a desired water conveying line with water coming from the water source/s.

There is also provided a dedicated fourth water conveying line 38*d* for generating one or more water jets directed into the first compartment 23*a* which receives the detergent pod DP. The water jets are suited to hit the detergent pod DP and to break/perforate/cut its water-soluble pouch P.

For simplicity's sake, hereinafter we will use the sole term "break" to indicate the action of perforating or cutting the water-soluble pouch P of the detergent pod DP. The action of breaking or perforating or cutting the water-soluble pouch has to be intended as an action of breaking the water-soluble pouch by a mechanical action of the water jet and not exclusively by dissolution of the water-soluble pouch in contact with water.

At this purpose, the water distributor 35 comprises a fourth inlet connector 36*d* connectable, via a dedicated fourth controllable valve 40*d*, to the water source E; the fourth inlet connector 36*d* can be fed with cold or warm or hot water.

Inlet of the fourth controllable valve 40*d* is connectable to the water source E and outlet of the fourth controllable valve 40*d* is connected, through a respective pipe 34*d*, to the fourth inlet connector 36*d* of the water distributor 35.

Preferably the fourth water conveying line 38*d* is fluidly connected to the fourth inlet connector 36*d* and communicates with a region of the wash dispenser 35 which is positioned above the first compartment 23*a* of the drawer 22.

Water is therefore conveyed to the first compartment 23*a* of the drawer 22 by activating the fourth valve 40*d* and making the water flowing through the fourth water conveying line 38*d*.

The fourth water conveying line 38*d* is preferably provided with nozzles 41, 42 and 43 adapted to allow the passage of the water from the fourth water conveying line 38*d* to the underlying first compartment 23*a* and adapted for generating said water jets. As said above, the impact of the water jets against the detergent pod DP breaks its water-soluble pouch P.

Nozzles 41, 42 and 43 generate at its outputs the water jets with the required direction. Furthermore, the shape of the nozzles 41, 42 and 43 guarantees that the water jets are laminar-flow water jets.

As a result, the water jet doesn't spread out and every part of the flow travels in a substantially straight line.

When the detergent pod DP is received in the first compartment 23*a*, the water jets hit the water-soluble pouch P of the detergent pod DP and breaks it.

With laminar-flow water jet it has to be intended that the water is ejected from the nozzle in a coherent stream. The coherent stream substantially maintains its shape from the nozzle to the target, in the present case the target is the detergent pod DP.

The laminar-flow water jet, therefore, is a flow which substantially maintains its shape (or cross section) throughout its extension.

The shape of the stream is determined by the shape of the nozzle or, in other words, the nozzle is shaped to produce a stream that is of a particular shape.

Preferably, the output water jets are generated to be directed in an area of the first compartment 23*a* adjacent to the stopping device 30.

In an embodiment of the invention, the laundry washing cycle is advantageously carried out using powder or liquid detergent as known in the art. In this case, the first compartment 23*a* of the treating agents dispenser 20 is filled with powder detergent or the second compartment 23*b* is filled with liquid detergent. Then, advantageously, the third compartment 23*c* may be filled with a softener and/or the fourth compartment 23*d* may be filled with other treating agents, such as fabric conditioners, waterproofing agents, fabric enhancers, rinse sanitization additives, chlorine-based additives, etc. By operating on the interface unit 16 the user selects the desired washing program, for example a standard washing program. The control unit 11 controls the laundry washing machine 1 so that it may start the washing program and dispensing, when required, the proper treating agent from the treating agents dispenser 20 to the washing tub 3.

The treating agent is dispensed from the treating agents dispenser 20 to the washing tub 3 by making flow an amount of flushing water into the proper compartment so as to flush out the treating agent contained therein and convey it into the washing tub 3 through the outlet port 24 and the supply pipe 18.

For example, during the main washing phase of the washing cycle the powder detergent is dispensed from the treating agents dispenser 20 to the washing tub 3 by making flow an amount of flushing water into the first compartment 23*a* so as to flush out the powder detergent contained therein and convey it into the washing tub 3 through the outlet port 24 and the supply pipe 18.

The washing cycle then continues with the following phases, draining phases, spinning cycles, rinsing phases, etc., or further water loads.

According to a preferred aspect of the invention, the laundry washing cycle is advantageously carried out introducing a detergent pod DP inside the first compartment 23*a*. The third compartment 23*c* may be filled with a softener and the fourth compartment 23*d* may be filled with other treating agents, such as fabric conditioners, waterproofing agents, fabric enhancers, rinse sanitization additives, chlorine-based additives, etc.

In this case, the main washing phase of the washing cycle is carried out using water and the detergent D of the detergent pod DP. The detergent D of the detergent pod DP is dispensed from the first compartment 23*a* to the washing tub 3, as will be described in the following.

In a preferred embodiment of the invention, a washing program wherein the main washing phase is carried out using the detergent pod DP is opportunely selected by the user by operating the "Pods cycle" button 16*c* on the interface unit 16. In different embodiments, the washing program which uses a detergent pod DP may be select in an appropriate menu selectable through the display of the interface unit 16.

In a further preferred embodiment of the invention, a washing program wherein the washing phase is carried out using the detergent pod DP may be automatically set by the laundry washing machine thanks to a sensor, not illustrated, associated to the treating agents dispenser 20 which is able to detect the presence of a detergent pod DP inside the first compartment 23*a*.

For example, the sensor may be an optical sensor or a conductivity sensor.

In further preferred embodiments, then, no actions are taken when using the detergent pod DP and therefore any of the washing programs selectable by the user will perform a washing cycle suitable for detergent pod DP. In this case, if powder or liquid detergent is used instead of a detergent pod PD, the washing cycle suitable for the detergent pod PD will be performed.

Figure 9:
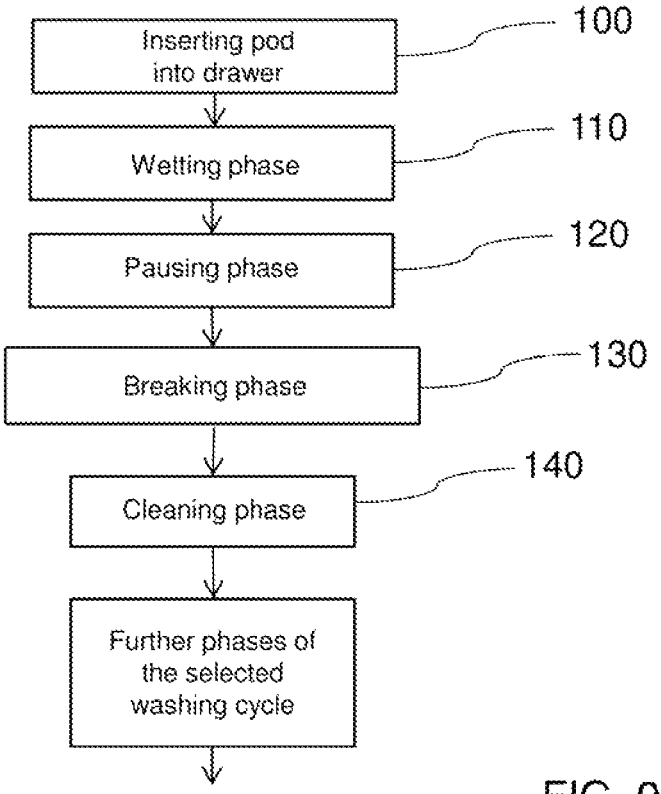
FIG. 9 illustrates a schematic flow chart diagram of a method for operating a laundry washing machine during a washing cycle according to a preferred embodiment of the present invention.

A preferred functioning of the laundry washing machine 1 according to the invention is described hereinafter with reference to FIG. 9.

The detergent pod DP is placed by the user inside the first compartment 23*a* (step 100), preferably in a predefined zone inside the first compartment 23*a* adjacent to the stopping device 30, more preferably in abutment to the ribs 31*a*, 31*b* of the stopping device 30.

The predefined zone inside the first compartment 23*a* substantially corresponds, therefore, with the area close to the ribs 31*a*, 31*b* of the stopping device 30.

The detergent pod DP is advantageously maintained inside the first compartment 23*a* by means of the stopping device 30 which prevents the detergent pod DP slipping towards the rear aperture 26 of the first compartment 23*a*.

The drawer 22 is then positioned in its closed operating position.

The method according to the invention comprises a first phase (step 110), or wetting phase, wherein a first amount of water Qw1 is conveyed into the first compartment 23*a* in order to wet the detergent pod DP. In particular, the first amount of water gets into contact with the external pouch P of the detergent pod DP.

At this purpose the first amount of water Qw1 is conveyed into the first compartment 23*a* during a predetermined first period of time t1, or wetting time period t1. The wetting time period t1 is preferably comprised between 1 sec and 10 sec, more preferably set at a predetermined value of 3 sec.

In a preferred embodiment of the invention, the first amount of water Qw1 is conveyed into the first compartment 23*a* through outlets 29 of the first water conveying line 38*a*.

In a further preferred embodiment of the invention, the first amount of water Qw1 is conveyed into the first compartment 23*a* through water jets generated by nozzles 41, 42 or 43 of the fourth water conveying line 38*d*.

In this case, the water jets are activated for a short period of time so that they do not achieve the breaking action but only the wetting action of the detergent pod DP.

In a further preferred embodiment of the invention, the first amount of water Qw1 is conveyed into the first compartment 23*a* through both outlets 29 of the first water conveying line 38*a* and nozzles 41, 42 or 43 of the fourth water conveying line 38*d*.

The first amount of water Qw1 is preferably cold water, coming from the water source E, and/or warm or hot water, coming from source E'.

After the wetting phase (step 110) the method comprises a second phase (step 120), or pausing phase, wherein the detergent pod DP is maintained into the first compartment 23*a* for a predetermined second period of time t2, or waiting time, during which the external pouch P of the detergent pod DP, previously wetted in the wetting phase (step 110), jellified.

The waiting time period t2 is preferably comprised between 5 sec and 150 sec, preferably set at a predetermined value of 30 sec.

The waiting time period t2 is opportunely choose to guarantee the external pouch P to turn into jelly and, at the same time, to avoid the external pouch P in the gelatinous state to stuck at side walls of the fist compartment 23*a*, in particular at the bottom wall 62*a* of the fist compartment 23*a*.

After the waiting phase (step 120) the method comprises a third phase (step 130), or breaking phase, wherein a detergent pod breakage step of breaking the water-soluble pouch P of the detergent pod DP is carried out.

Preferably, a second amount of water Qw2 is directed towards the detergent pod DP, in particular towards the jelly external pouch P of the detergent pod DP.

More preferably, by opening the fourth controllable valve 40*d*, the second amount of water Qw2, coming from the water source E, enters the water distributor 35 and flows into the fourth water conveying line 38*d* up to the nozzles 41, 42 and 43. Water jets generated by the nozzles 41, 42 and 43 are directed towards the detergent pod DP, in particular towards the jelly external pouch P of the detergent pod DP.

The water jets perforates/cuts for the detergent pod DP. The water penetrates into the jelly external pouch P and breaks open the detergent pod D with release of detergent D contained therein.

The fourth controllable valve 40*d* is preferably kept activated for a proper period of time tb which is considered sufficient to break the pouch P.

The second amount of water Qw2 is preferably comprised between 1 litre and 7 litres, preferably set at a value of 4 litres.

The second amount of water Qw2 is preferably cold water, coming from the water source E. In different embodiments, the second amount of water can be warm or hot water, coming from source E'.

Once the external pouch P has been broken, the dose of released detergent D previously contained in the detergent pod DP is ready to be conveyed into the washing tub 3.

In a preferred embodiment, the second amount of water Qw2 conveyed into the first compartment 23*a* through the nozzles 41, 42 and 43 flushes out part of, or totally, the dose of released detergent D and conveys it into the washing tub 3 through the outlet port 24 and the supply pipe 18.

At the same time, part of, or totally, the pouch P of the detergent pod PD is flushed out and conveyed into the washing tub 3 through the outlet port 24 and the supply pipe 18.

Advantageously, the pouch P of the detergent pod PD does not stick at the side walls of the first compartment 23*a*.

In a further preferred embodiment, after the breaking phase (step 130) the method comprises a fourth phase (step 140), or cleaning phase, wherein a third amount of water Qw3 is conveyed into the first compartment 23*a* in order to clean the first compartment 23*a*.

The third amount of water Qw3 is preferably comprised between 1 litre and 12 litres, preferably set at a value of 6 litres.

In a preferred embodiment of the invention, the third amount of water Qw3 is conveyed into the first compartment 23*a* through outlets 29 of the first water conveying line 38*a*.

In a further preferred embodiment of the invention, the third amount of water Qw3 is conveyed into the first compartment 23*a* through water jets of the fourth water conveying line 38*d*.

In a further preferred embodiment of the invention, the third amount of water Qw3 is conveyed into the first compartment 23*a* through both outlets 29 of the first water conveying line 38*a* and water jets of the fourth water conveying line 38*d*.

The third amount of water Qw3 is preferably cold water, coming from the water source E, and/or warm or hot water, coming from source E'.

Advantageously, the third amount of water Qw3 cleans the side walls of the first compartment 23*a*. Furthermore, the third amount of water Qw3 flushes out released detergent D of the pod PD not previously flushed out.

At the same time, the third amount of water Qw3 flushes out residues of pouch P not previously flushed out.

This further guarantee that the pouch P of the detergent pod PD does not stick at the side walls of the first compartment 23*a*.

In a further preferred embodiment of the invention, the detergent pod breaking phase and said cleaning phase may be carried out simultaneously, being clear that the detergent will be flushed out from the first compartment 23*a* once the detergent pod DP has been broken.

An illustrative example of a preferred embodiment of the method for dispensing a dose of detergent D and water into the washing tub 3 is described in the following:

- a detergent pod DP in inserted into the first compartment 23*a* of the drawer 22 and the drawer 22 is closed;
- the user selects the washing program which uses detergent pods (for example through the "Pods cycle" button 16*c* of the interface unit 16);

a first amount of water Qw1 is conveyed into the first compartment 23*a* through outlets 29 of the first water conveying line 38*a* for a predetermined period of time, for example 3 sec.; then make a pause of 30 sec; then the fourth valve 40*d* is activated (opened) for a predetermined period of time, for example 30 sec, so that water jets are generated by the nozzles 41, 42 and 43 and the detergent pod DP, in particular the pouch P of the detergent pod DP, is broken; then the first valve 40*a* is activated again for a predetermined period of time so that a quantity of flushing water, for example 6 liters, is introduced inside the first compartment 23*a* for cleaning the first compartment 23*a* and/or conveying detergent D into the washing tub 3.

The washing cycle may then proceed with the following phases, such as water heating, drum rotation, draining phases, spinning cycles, etc., or further water loads.

The method according to the preferred embodiments of the invention has been advantageously described in particular with reference to a detergent pod DP.

It has to be noted that the method may be also be performed when a different unit dose package is utilized which have to be dispensed during a washing cycle.

It has thus been shown that the present invention allows all the set objects to be achieved. In particular, it makes it possible to provide a method for operating a laundry washing machine using a unit dose package which prevents accumulation of residues in the treating agents dispenser.

It is underlined that the laundry washing machines illustrated in the enclosed figures are of the front-loading type; however it is clear that the system according to the invention can be applied as well to a top-loading washing machine, substantially without any modification.

While the present invention has been described with reference to the particular embodiment shown in the figures, it should be noted that the present invention is not limited to the specific embodiment illustrated and described herein; on the contrary, further variants of the embodiments described herein fall within the scope of the present invention, which is defined in the claims.

The invention claimed is:

1. A laundry washing machine comprising:

a casing;

a washing tub mounted inside the casing;

a drum rotatably mounted inside the washing tub and configured to receive laundry therein;

a treating agents dispenser comprising one or more compartments including a first compartment configured to receive a unit dose package comprising a pre-measured amount of treating agent incorporated into a water-soluble pouch, the first compartment having an outlet in fluid communication with the washing tub;

a water supply system comprising:

a plurality of valves, each configured to be connected to one of one or more water sources, and a plurality of water conveying lines configured to convey water from each of the plurality of valves to the one or more compartments, wherein the plurality of water conveying lines comprises a first water conveying line connecting a first valve of the plurality of valves to the first compartment, the first water conveying line being enclosed from the first valve to at least one first outlet located at the first compartment to thereby cause water passing through the at least one first outlet to form a jet; and a control unit configured to operate plurality of valves, wherein the control unit is configured to:

during a first period of time, perform a wetting operation comprising opening the first valve to convey a first amount of water through the first water conveying line and the at least one first outlet to the first compartment, the first amount of water being selected to wet the unit dose package;

following the first period of time, perform a pause operation comprising closing the first valve such that no water is conveyed to the first compartment during a second period of time;

following the second period of the time, perform a breaking operation comprising opening the first valve to convey a second amount of water through the first water conveying line and the at least one first outlet to the first compartment, the second amount of water being selected to break the water-soluble pouch of the unit dose package inside the first compartment so that the pre-measured amount of treating agent is released.

2. The laundry washing machine of claim 1, wherein the each at least one first outlet is configured to generate a laminar-flow water jet.

3. The laundry washing machine of claim 1, wherein the first period of time comprises between 1 second and 10 seconds.

4. The laundry washing machine of claim 1, wherein the first period of time comprises 3 seconds.

5. The laundry washing machine of claim 1, wherein the second period of time comprises between 5 seconds and 150 seconds.

6. The laundry washing machine of claim 1, wherein the second period of time comprises 30 seconds.

7. The laundry washing machine of claim 1, wherein the second amount of water comprises between 1 litre and 7 litres.

8. The laundry washing machine of claim 1, wherein the second amount of water comprises 4 litres.

9. The laundry washing machine of claim 1, wherein the second amount of water is conveyed for a time period suitable to break the water-soluble pouch.

10. The laundry washing machine of claim 1, wherein the control unit is further configured to, following the breaking operation, perform a flushing operation comprising conveying a third amount of water to the treating agents dispenser, the third amount of water being selected to clean the first compartment and/or to flush out the released pre-measured amount of treating agent from the first compartment and to convey it into the washing tub.

11. The laundry washing machine of claim 10, wherein the third amount of water comprises between 1 litre and 12 litres.

12. The laundry washing machine of claim 10, wherein the third amount of water comprises 6 litres.

13. The laundry washing machine of claim 1, wherein the first compartment comprises a predefined zone configured to receive the unit dose package.

14. The laundry washing machine of claim 1, further comprising a user interface configured to receive a user selection of one of a plurality of washing programs, and wherein the control unit is further configured to determine that the user interface has received a selection at the user interface of a dedicated washing program as a predicate to performing the breaking operation.

15. The laundry washing machine of according to claim 1, wherein the control unit is further configured to detect a presence of the unit dose package in the first compartment as a predicate to performing the breaking operation.

16. The laundry washing machine of claim 1, further comprising a fluid supply line fluidly connecting the outlet of the first compartment with the washing tub.

17. The laundry washing machine of claim 1, wherein the one or more compartments further comprises at least a second compartment configured to receive a treating agent in a powder or liquid form.

18. The laundry washing machine of claim 1, wherein the outlet of the first compartment is configured to prevent an intact unit dose package from passing through the outlet.

19. The laundry washing machine of claim 1, wherein the first compartment comprises a rib adjacent to the outlet and configured to hold an intact unit dose package away from the outlet.

20. The laundry washing machine of claim 1, wherein the first compartment comprises a plurality of ribs adjacent to the outlet and configured to hold an intact unit dose package away from the outlet.

21. The laundry washing machine of claim 1, wherein the first compartment comprises a plurality of ribs extending vertically adjacent to the outlet and configured to hold an intact unit dose package away from the outlet.

22. The laundry washing machine of claim 1, wherein the one or more water sources comprises a hot water source and a cold water source.

23. The laundry washing machine of claim 10, wherein the control unit is configured to perform the flushing operation by opening a second valve of the plurality of valves to convey at least a portion of the third amount of water through a second one of the plurality of water conveying lines to at least one second outlet located at the first compartment.

24. The laundry washing machine of claim 10, wherein the control unit is configured to perform the flushing operation by opening a second valve of the plurality of valves to convey a first portion of the third amount of water through a second one of the plurality of water conveying lines to at least one second outlet located at the first compartment, and opening the first valve to convey a second portion of the third amount of water through the at least one first outlet.

* * * * *